US009995016B1

(12) United States Patent
Howell et al.

(10) Patent No.: US 9,995,016 B1
(45) Date of Patent: Jun. 12, 2018

(54) EXCAVATOR LIMB LENGTH AND OFFSET ANGLE DETERMINATION USING A LASER DISTANCE METER

(71) Applicant: Caterpillar Trimble Control Technologies LLC, Dayton, OH (US)

(72) Inventors: Mark Nicholas Howell, Christchurch (NZ); Samuel Joseph Frei, Christchurch (NZ)

(73) Assignee: Caterpillar Trimble Control Technologies LLC, Dayton ( * ) Notice: Subject to any disclaimer, the term of this patent is extended or adjusted under 35 U.S.C. 154(b) by 16 days.

(21) Appl. No.: 15/364,778

(22) Filed: Nov. 30, 2016

(51) Int. Cl.
*G06F 7/70* (2006.01)
*E02F 3/43* (2006.01)
(Continued)

(52) U.S. Cl.
CPC ..... *E02F 3/435* (2013.01); *E02F 3/32* (2013.01); *E02F 9/2025* (2013.01); *E02F 9/265* (2013.01)

(58) Field of Classification Search
CPC . E02F 3/435; E02F 3/32; E02F 9/2025; E02F 9/265; E02F 9/26; E02F 9/264; G01B 21/042
(Continued)

(56) References Cited

U.S. PATENT DOCUMENTS 4,829,418 A * 5/1989 Nielsen ..... E02F 3/435 172/4.5
5,682,311 A * 10/1997 Clark ..... E02F 3/435 172/4.5
(Continued)

OTHER PUBLICATIONS

Trimble GCS900 Grade Control System for Excavators, Version 12.60, Revision A, Part Number, Feb. 2014.

*Primary Examiner* — Shardul D Patel
(74) *Attorney, Agent, or Firm* — Dinsmore & Shohl, LLP

(57) ABSTRACT

A framework comprises a laser distance meter (LDM), reflector, and excavator comprising a chassis, linkage assembly (LA), boom and stick sensors, implement, and control architecture. The LA comprises a boom and stick defining LA positions. The LDM is configured to generate a $D_{LDM}$ and $\theta_{INC}$ between the LDM and the reflector at a node, and the control architecture comprises actuator(s) and a controller programmed to execute at successive LA positions an iterative process (comprises generating $\theta_B$, generating $\theta_S$, and calculating a height H and a distance D between the node and the LDM based on $D_{LDM}$ and $\theta_{INC}$), build a set of H, D measurements and a corresponding set of $\theta_B$, $\theta_S$ for n LA positions, and execute a linear least squares optimization process based on the H, D set and corresponding set of $\theta_B$, $\theta_S$ to determine and operate the excavator using $L_B$, $L_S$, $\theta_B^{Bias}$, and $\theta_S^{Bias}$.

20 Claims, 5 Drawing Sheets

(51) Int. Cl.
*E02F 9/26* (2006.01)
*E02F 3/32* (2006.01)
*E02F 9/20* (2006.01)

(58) Field of Classification Search
USPC ..... 701/50, 33.1, 34.4; 414/200; 37/443, 37/414, 348
See application file for complete search history.

(56) References Cited

U.S. PATENT DOCUMENTS

| | | | | |
|---|---|---|---|---|
| 6,253,160 | B1 * | 6/2001 | Hanseder | E02F 3/435 342/357.27 |
| 6,263,595 | B1 * | 7/2001 | Ake | E02F 3/435 356/141.1 |
| 2003/0147727 | A1 * | 8/2003 | Fujishima | E02F 3/435 414/200 |
| 2011/0264336 | A1 * | 10/2011 | Bengtsson | E02F 3/3677 701/50 |
| 2015/0330060 | A1 * | 11/2015 | Seki | E02F 9/264 701/33.1 |
| 2016/0054114 | A1 * | 2/2016 | Crozier | G01L 311/14 702/151 |

* cited by examiner

EXCAVATOR LIMB LENGTH AND OFFSET ANGLE DETERMINATION USING A LASER DISTANCE METER

BACKGROUND

The present disclosure relates to excavators which, for the purposes of defining and describing the scope of the present application, comprise an excavator boom and an excavator stick subject to swing and curl, and an excavating implement that is subject to swing and curl control with the aid of the excavator boom and excavator stick, or other similar components for executing swing and curl movement. For example, and not by way of limitation, many types of excavators comprise a hydraulically or pneumatically or electrically controlled excavating implement that can be manipulated by controlling the swing and curl functions of an excavating linkage assembly of the excavator. Excavator technology is, for example, well represented by the disclosures of U.S. Pat. No. 8,689,471, which is assigned to Caterpillar Trimble Control Technologies LLC and discloses methodology for sensor-based automatic control of an excavator, US 2008/0047170, which is assigned to Caterpillar Trimble Control Technologies LLC and discloses an excavator 3D laser system and radio positioning guidance system configured to guide a cutting edge of an excavator bucket with high vertical accuracy, and US 2008/0000111, which is assigned to Caterpillar Trimble Control Technologies LLC and discloses methodology for an excavator control system to determine an orientation of an excavator sitting on a sloped site, for example.

BRIEF SUMMARY

According to the subject matter of the present disclosure, an excavator calibration framework comprising an excavator, a laser distance meter (LDM), and a laser reflector. The excavator comprises a machine chassis, an excavating linkage assembly, a boom dynamic sensor, a stick dynamic sensor, an excavating implement, and control architecture. The excavating linkage assembly comprises an excavator boom and an excavator stick that collectively define a plurality of linkage assembly positions. The boom dynamic sensor is positioned on the excavator boom and the stick dynamic sensor is positioned on the excavator stick. The excavating linkage assembly is configured to swing with, or relative to, the machine chassis. The excavator stick is configured to curl relative to the excavator boom. The excavating implement is mechanically coupled to the excavator stick. The LDM is configured to generate an LDM distance signal $D_{LDM}$ indicative of a distance between the LDM and the laser reflector and an angle of inclination $\theta_{INC}$ indicative of an angle between the LDM and the laser reflector. The laser reflector is configured to be disposed at a position corresponding to a calibration node on the excavator stick, and the control architecture comprises one or more linkage assembly actuators and an architecture controller programmed to execute an iterative process at successive linkage assembly positions. The iterative process comprises generating a boom measured angle $\theta_B$ from the boom dynamic sensor, generating a stick measured angle $\theta_S$ from the stick dynamic sensor, and calculating a height H and a distance D between the calibration node and the LDM based on the LDM distance signal $D_{LDM}$ and angle of inclination $\theta_{INC}$. The architecture controller is further programmed to build a set of height H and distance D measurements and a corresponding set of boom measured angles $\theta_B$ and stick measured angles $\theta_S$ for n linkage assembly positions, execute an optimization process comprising a linear least squares optimization based on the set of height H and distance D measurements and the corresponding set of boom measured angles $\theta_B$ and stick measured angles $\theta_S$ to determine a boom limb length $L_B$, a stick limb length $L_S$, a boom offset angle $\theta_B^{Bias}$, and a stick offset angle $\theta_S^{Bias}$, and operate the excavator using $L_B$, $L_S$, $\theta_B^{Bias}$, and $\theta_S^{Bias}$.

In accordance with one embodiment of the present disclosure, an excavator calibration framework comprising an excavator, a laser distance meter (LDM), and a laser reflector. The excavator comprises a machine chassis, an excavating linkage assembly, a boom dynamic sensor, a stick dynamic sensor, an excavating implement, and control architecture. The excavating linkage assembly comprises an excavator boom and an excavator stick that collectively define a plurality of linkage assembly positions. The boom dynamic sensor is positioned on the excavator boom and the stick dynamic sensor is positioned on the excavator stick. The excavating linkage assembly is configured to swing with, or relative to, the machine chassis. The excavator stick is configured to curl relative to the excavator boom. The excavating implement is mechanically coupled to the excavator stick. The LDM is configured to generate an LDM distance signal $D_{LDM}$ indicative of a distance between the LDM and the laser reflector and an angle of inclination $\theta_{INC}$ indicative of an angle between the LDM and the laser reflector. The laser reflector is configured to be disposed at a position corresponding to a calibration node of the excavator stick, the calibration node is at a terminal point G of the excavator stick at an end of the excavator stick mechanically coupled to the excavating implement, and the laser reflector disposed at the terminal point G. The control architecture comprises one or more linkage assembly actuators and an architecture controller programmed to execute an iterative process at successive linkage assembly positions. The iterative process comprises generating a boom measured angle $\theta_B$ from the boom dynamic sensor, generating a stick measured angle $\theta_S$ from the stick dynamic sensor, and calculating a height H and a distance D between the calibration node and the LDM based on the LDM distance signal $D_{LDM}$ and angle of inclination $\theta_{INC}$. The architecture controller is further programmed to build a set of height H and distance D measurements and a corresponding set of boom measured angles $\theta_B$ and stick measured angles $\theta_S$ for n linkage assembly positions, execute an optimization process comprising a linear least squares optimization based on the set of height H and distance D measurements and the corresponding set of boom measured angles $\theta_B$ and stick measured angles $\theta_S$ to determine a boom limb length $L_B$, a stick limb length $L_S$, a boom offset angle $\theta_B^{Bias}$, and a stick offset angle $\theta_S^{Bias}$, and operate the excavator using $L_B$, $L_S$, $\theta_B^{Bias}$, $\theta_S^{Bias}$. The linear least squares optimization comprises a following optimization equation:

$$P=(X^TX)^{-1}X^TY$$

where P comprises a vector comprising a set of constants that are a function of at least one of $L_B$, $L_S$, $\theta_B^{Bias}$, $\theta_S^{Bias}$, X comprises a vector based on the corresponding set of boom measured angles $\theta_B$ and stick measured angles $\theta_S$, and Y comprises a vector based on the set of height H and distance D measurements.

Although the concepts of the present disclosure are described herein with primary reference to the excavator illustrated in FIG. 1, it is contemplated that the concepts will enjoy applicability to any type of excavator, regardless of its particular mechanical configuration. For example, and not by way of limitation, the concepts may enjoy applicability to a backhoe loader including a backhoe linkage.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure relates to earthmoving machines and, more particularly, to earthmoving machines such as excavators including components subject to adaptive control. For example, and not by way of limitation, many types of excavators typically have a hydraulically controlled earthmoving implement that can be manipulated by a joystick or other means in an operator control station of the machine, and is also subject to partially or fully automated adaptive control. The user of the machine may control the lift, tilt, angle, and pitch of the implement. In addition, one or more of these variables may also be subject to partially or fully automated control based on information sensed or received by an adaptive environmental sensor of the machine. In the embodiments described herein, an excavator calibration framework utilizes a laser distance meter to determine limb lengths of excavator limb components and sensor offsets of sensors disposed on those respective limbs, as described in greater detail further below. Such determined values may be utilized by an excavator control to operate the excavator.

Figure 1:
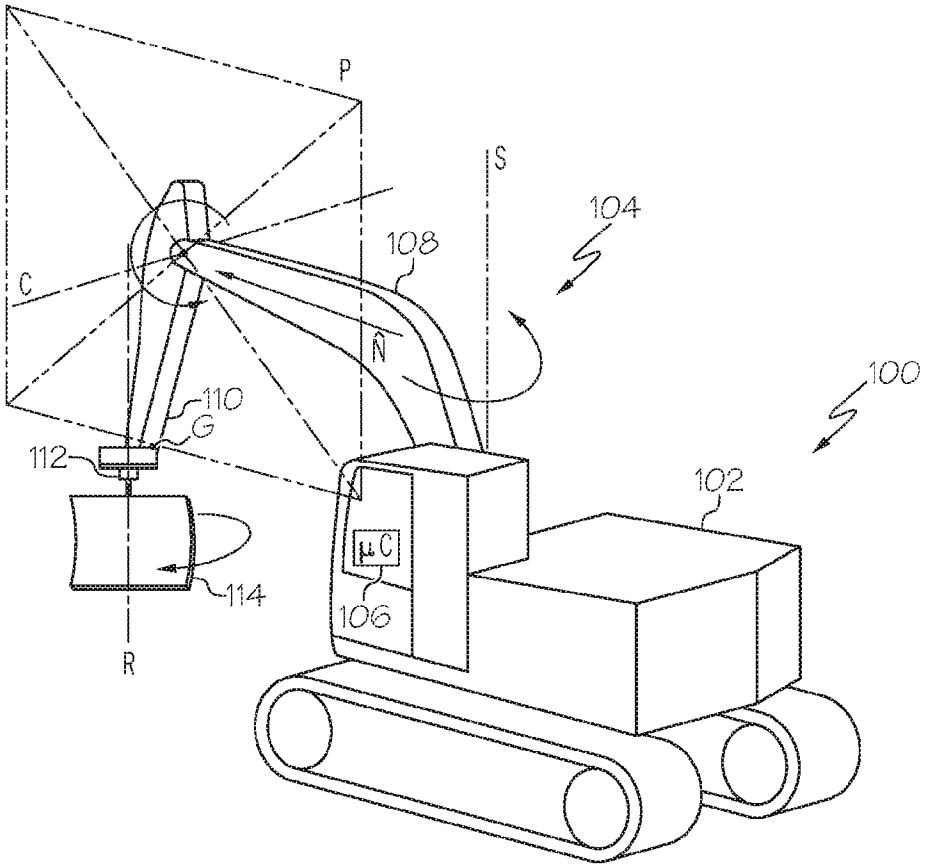
FIG. 1 illustrates an excavator incorporating aspects of the present disclosure.
Figure 2:
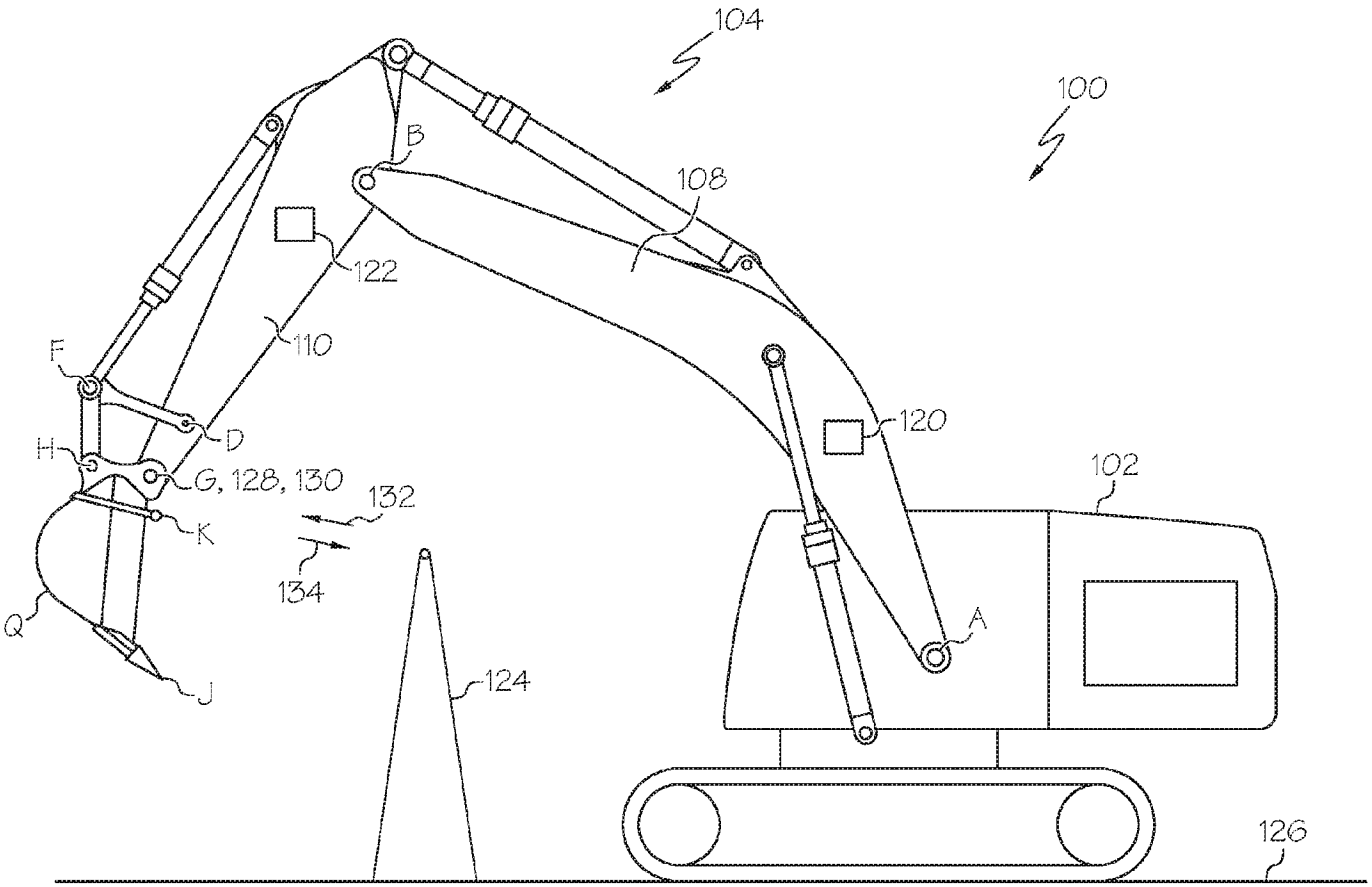
FIG. 2 is a side view of an excavator incorporating aspects of the present disclosure.
Figure 5:
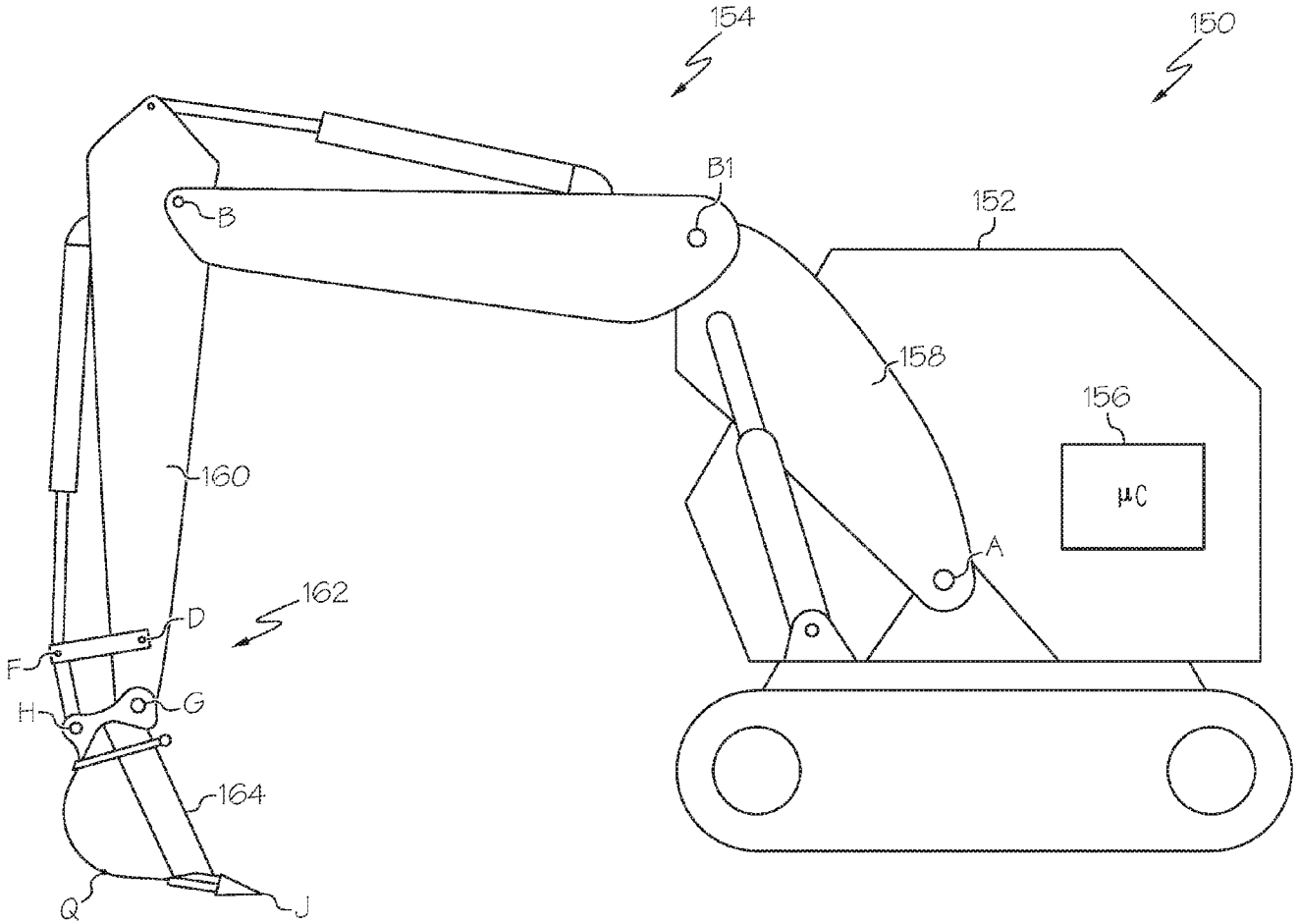
FIG. 5 is a side view of another excavator incorporating aspects of the present disclosure.

Referring initially to FIGS. 1-2 and 5, an excavator calibration framework comprises an excavator 100, 150, a laser distance meter (LDM) 124, and a laser reflector 130. The excavator 100, comprises a machine chassis 102, 152, an excavating linkage assembly 104, 154, a boom dynamic sensor 120, a stick dynamic sensor 122, an excavating implement 114, 164, and control architecture 106, 156. The excavating linkage assembly 104, 154 comprises an excavator boom 108, 158 and an excavator stick 110, 160 that collectively define a plurality of linkage assembly positions. The boom dynamic sensor 120 is positioned on the excavator boom 108 and the stick dynamic sensor 122 is positioned on the excavator stick 110. In an embodiment, the boom dynamic sensor 120 may be positioned on the excavator boom 158 and the stick dynamic sensor 122 may be positioned on the excavator stick 160.

The excavator boom 158 of FIG. 5 differs from the excavator boom 108 of FIG. 1 in that the excavator boom 158 comprises a two-piece, variable-angle (VA) excavator boom, as will be described in greater detail below. While the excavator 100 will be referenced herein, it should be understood that the embodiments described below also apply to the excavator 150.

Figure 3:
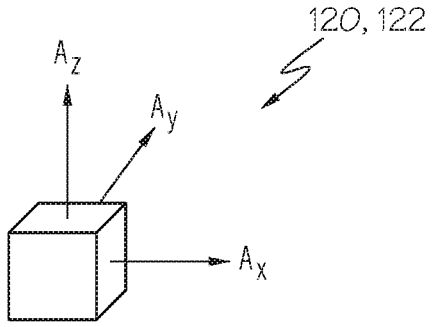
FIG. 3 is an isometric view of a dynamic sensor, which can be disposed on a linkage of the excavator of FIG. 2.

In embodiments, and referring to FIG. 3, the dynamic sensor 120, 122 comprises an inertial measurement unit (IMU), an inclinometer, an accelerometer, a gyroscope, an angular rate sensor, a rotary position sensor, a position sensing cylinder, or combinations thereof. For example, the dynamic sensor 120, 122 may comprise an IMU comprising a 3-axis accelerometer and a 3-axis gyroscope. As shown in FIG. 3, the dynamic sensor 120, 122 includes accelerations $A_x$, $A_y$, and $A_z$, respectively representing x-axis, y-axis-, and z-axis acceleration values.

The excavating linkage assembly 104 may be configured to define a linkage assembly heading $\hat{N}$ and to swing with, or relative to, the machine chassis 102 about a swing axis S of the excavator 100. The excavator stick 110 is configured to curl relative to the excavator boom 108. For example, the excavator stick 110 may be configured to curl relative to the excavator boom 108 about a curl axis C of the excavator 100. The excavator boom 108 and excavator stick 110 of the excavator 100 illustrated in FIG. 1 are linked by a simple mechanical coupling that permits movement of the excavator stick 110 in one degree of rotational freedom relative to the excavator boom 108. In these types of excavators, the linkage assembly heading $\hat{N}$ will correspond to the heading of the excavator boom 108. However, the present disclosure also contemplates the use of excavators equipped with offset booms where the excavator boom 108 and excavator stick 110 are linked by a multidirectional coupling that permits movement in more than one rotational degree of freedom. See, for example, the excavator illustrated in U.S. Pat. No. 7,869,923 ("Slewing Controller, Slewing Control Method, and Construction Machine"). In the case of an excavator with an offset boom, the linkage assembly heading $\hat{N}$ will correspond to the heading of the excavator stick 110.

The excavating implement 114 is mechanically coupled to the excavator stick 110. For example, referring to FIG. 1, the excavating implement 114 is mechanically coupled to the excavator stick 110 through an implement coupling 112. Further, referring to FIG. 5, the excavating implement 154 is mechanically coupled to the excavator stick 160 through an implement coupling 162, which comprises a four-bar linkage comprising points F, H, D, and terminal point G. The excavating implement 154 may further comprise a terminal tooth point J and a terminal rear end point Q.

The excavating implement 114 may be mechanically coupled to the excavator stick 110 via the implement coupling 112 and configured to rotate about a rotary axis R. In an embodiment, the rotary axis R may be defined by the implement coupling 112 joining the excavator stick 110 and the rotary excavating implement 114. In an alternative embodiment, the rotary axis R may be defined by a multidirectional, stick coupling joining the excavator boom 108 and the excavator stick 110 along the plane P such that the excavator stick 110 is configured to rotate about the rotary axis R. Rotation of the excavator stick 110 about the rotary axis R defined by the stick coupling may result in a corresponding rotation of the rotary excavating implement 114, which is coupled to the excavator stick 110, about the rotary axis R defined by the stick coupling.

Figure 4:
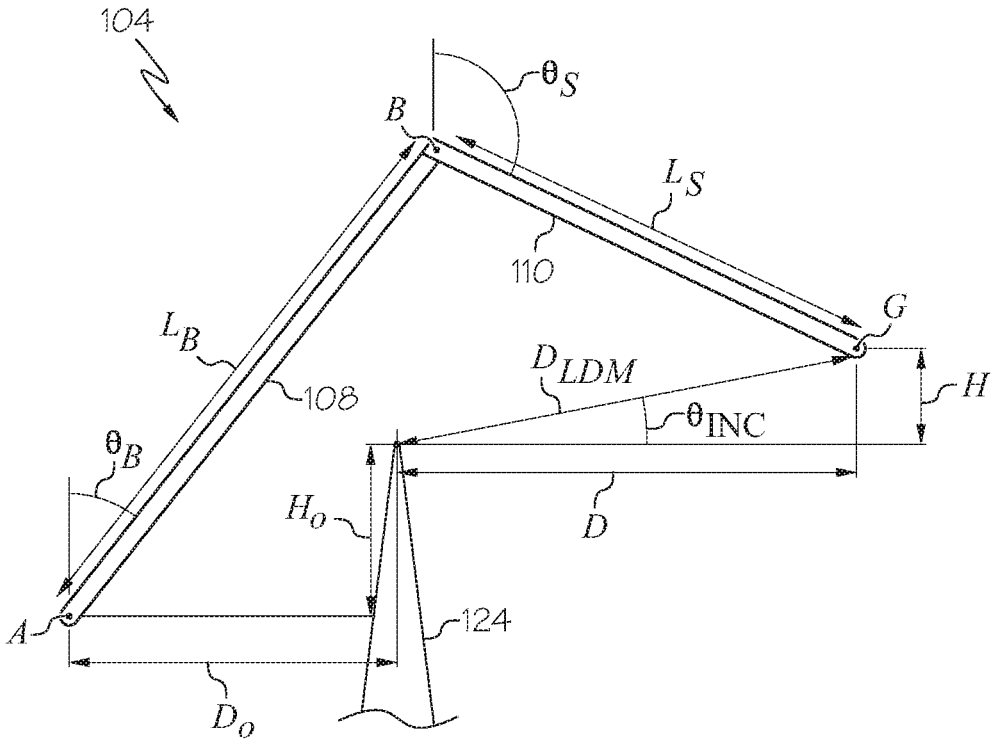
FIG. 4 is a side elevation view of a linkage assembly of the excavator of FIG. 2.

As illustrated in FIGS. 2 and 4, the LDM 124 is configured to generate an LDM distance signal $D_{LDM}$ indicative of a distance between the LDM 124 and the laser reflector 130 and an angle of inclination $\theta_{INC}$ indicative of an angle between the LDM 124 and the laser reflector 130 relative to horizontal. The laser reflector 130 is configured to be disposed at a position corresponding to a calibration node 128 on the excavator stick 110. In an embodiment, the laser reflector 130 is disposed on a pole. The pole may be secured to the excavator stick 110. Alternatively, the laser reflector 130 is secured directly to excavator stick 110. In a further embodiment, the calibration node 128 is at a terminal point G of the excavator stick 110 at an end of the excavator stick 110 mechanically coupled to the excavator implement 114. The laser reflector 130 may be additionally disposed at the terminal point G. The LDM 124 may be, for example, a Bosch GLM 100C LDM as made commercially available by Robert Bosch GmbH of Germany. A laser signal from the LDM 124 may be transmitted in a direction of an arrow 132 to the calibration node 128 and the laser reflector 130, and the laser signal may be reflected back to the LDM 124 in the direction of an arrow 134, as illustrated in FIG. 2.

The control architecture 106 comprises one or more linkage assembly actuators and an architecture controller programmed execute an iterative process at successive linkage assembly positions. The control architecture 106 may comprise a non-transitory computer-readable storage medium comprising machine readable instructions. The one or more linkage assembly actuators facilitate movement of the excavating linkage assembly 104. The one or more linkage assembly actuators comprise a hydraulic cylinder actuator, a pneumatic cylinder actuator, an electrical actuator, a mechanical actuator, or combinations thereof.

Figure 6:
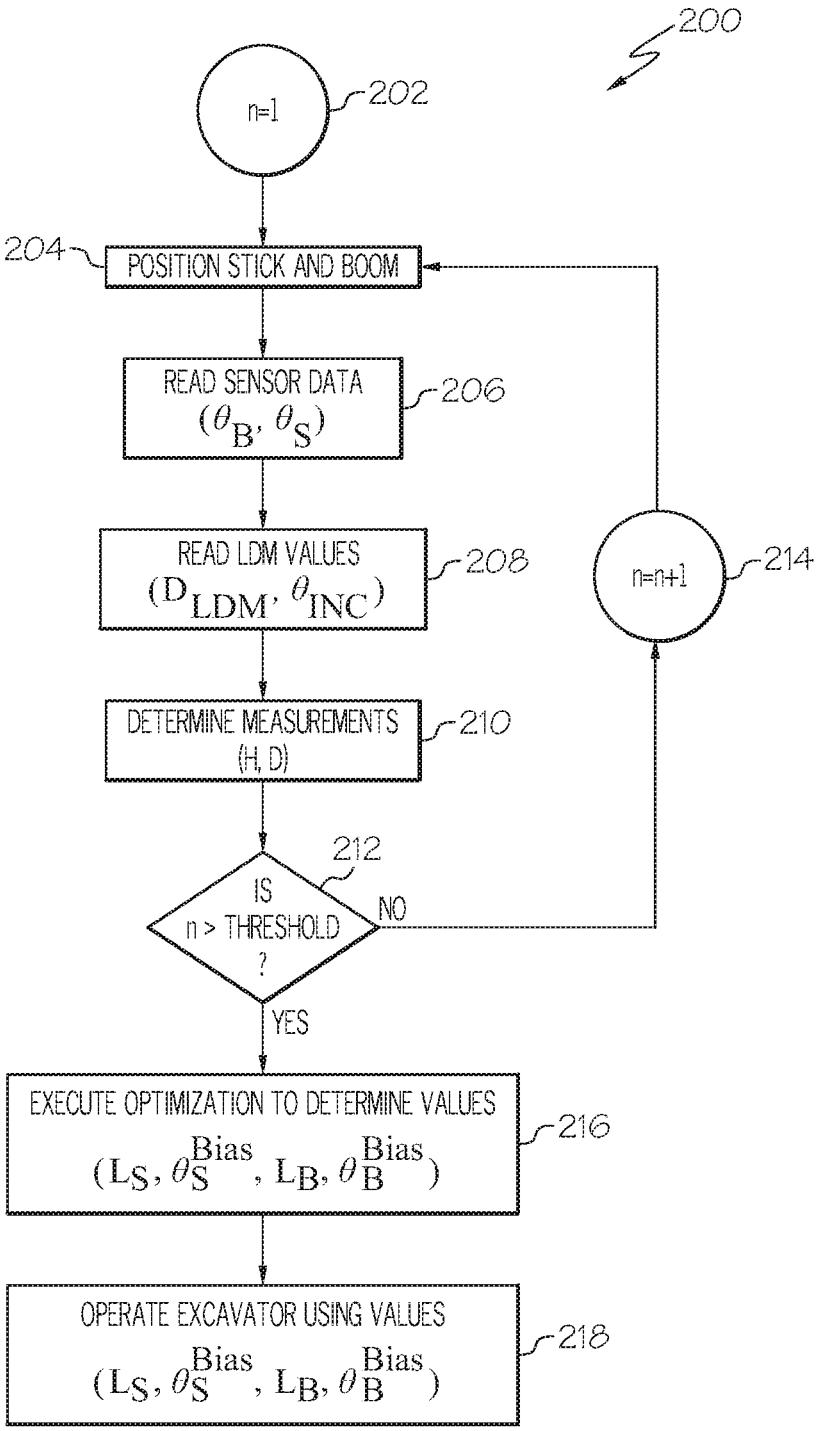
FIG. 6 is a flow chart illustrating an optimization process that may be used in a calibration routine to determine excavator limb lengths and sensor offset angles according to aspects of the present disclosure.

As shown in a control scheme 200 of FIG. 6, the iterative process comprises generating a boom measured angle $\theta_B$ from the boom dynamic sensor 120, generating a stick measured angle $\theta_S$ from the stick dynamic sensor 122, and calculating a height H and a distance D between the calibration node 128 and the LDM 124 based on the LDM distance signal $D_{LDM}$ and angle of inclination $\theta_{INC}$. For example, in step 202, n=1 as a starting point with respect to the iterative process. In step 204, the excavator boom 108 and the excavator stick 110 are positioned at a position such that, in step 206, a set of sensor data is read at the position, which data includes at least corresponding boom and stick measured angles $\theta_B$, $\theta_S$ as described in greater detail below. Further, in step 208, values from the LDM 124 are read by, for example, the controller, including, for example, the LDM distance signal $D_{LDM}$ and angle of inclination $\theta_{INC}$.

The architecture controller is further programmed to (1) build a set of height H and distance D measurements and a corresponding set of boom measured angles $\theta_B$ and stick measured angles $\theta_S$ for n linkage assembly positions, (2) execute an optimization process comprising a linear least squares optimization based on the set of height H and distance D measurements and the corresponding set of boom measured angles $\theta_B$ and stick measured angles $\theta_S$ to determine a boom limb length $L_B$, a stick limb length $L_S$, a boom offset angle $\theta_B^{Bias}$, and a stick offset angle $\theta_S^{Bias}$, and (3) operate the excavator using $L_B$, $L_S$, $\theta_B^{Bias}$, and $\theta_S^{Bias}$. For example, the boom limb length $L_B$ is a limb length of the excavator boom 108, the stick limb length $L_S$ is a limb length of the excavator stick 110, the boom offset angle $\theta_B^{Bias}$ is an angle of the boom dynamic sensor 120 with respect to an axis between a terminal point A and a terminal point B, and the stick offset angle $\theta_S^{Bias}$ is an angle of the stick dynamic sensor 122 with respect to an axis between the terminal point B and the terminal point G. In embodiments, the boom measured angle $\theta_B$ represents an angle of the excavator boom 108 relative to vertical and the stick measured angle $\theta_S$ represents an angle of the excavator stick 110 relative to vertical.

For example, referring to FIGS. 4-6, in step 210, the measurements of height H and distance D between the calibration node 128 and the LDM 124 are determined. If n as an iterative process step is not greater than an iterative threshold in step 212, then the iterative process repeats through steps 204-212. Otherwise, if n is greater than the iterative threshold in step 212, the control scheme 200 continues on to step 216 to determine limb length and sensor offset values through an optimization, as described in greater detail further below. In step 218, the excavator 100 is operated based on the determined values of step 216.

In embodiments, with respect to n linkage assembly positions, n is less than 20. For example, n=8. Further, the iterative process may comprise inputting a value for n that is configured to be manually modified or input by a user, or the iterative process comprises a pre -determined value for n.

The optimization process of step 216 may be executed using the height H and distance D measurements and the corresponding set of boom measured angles $\theta_B$ and stick measured angles $\theta_S$ for n−1 linkage assembly positions. In embodiments, the optimization process comprises a validation routine using height H and distance D measurements and corresponding boom and stick measured angles $\theta_B$, $\theta_S$ for a remaining linkage assembly position of the n linkage assembly positions. Additionally or alternatively, the optimization process comprises displaying a progress bar on a graphical user interface of the excavator calibration framework configured to display a change in a preceding last three estimations for at least one of $L_B$, $L_S$, $\theta_B^{Bias}$, $\theta_S^{Bias}$. For example, the progress bar displays a change in a preceding last three estimations of $L_B$.

In embodiments, the optimization process is executed using the height H and distance D measurements and the corresponding set of boom measured angles $\theta_B$ and stick measured angles $\theta_S$ for n−1 linkage assembly positions.

In an embodiment, the linear least squares optimization comprises a following optimization equation:

$$P=(X^TX)^{-1}X^TY \quad \text{(Equation 1)}$$

Equation 1 is a linear-in-lhe-parameters optimization equation, which may use a pscudoinvcrsc function on $P=X^{-1}Y$. Further, P comprises a vector comprising a set of constants that are a function of at least one of $L_B$, $L_S$, and $\theta_S^{Bias}$, X comprises a vector based on the corresponding set of boom measured angles $\theta_B$ and stick measured angles $\theta_S$, and Y comprises a vector based on the set of height H and distance D measurements. Further, for N linkage assembly positions ending at a linkage assembly position i, $$P = [P_1, P_2, P_3, P_4], \quad \text{(Equation 2)}$$

$$Y = \begin{bmatrix} H^{M_i} - H^{M_{1\ldots N(\neq i)}} \\ D^{M_i} - D^{M_{1\ldots N(\neq i)}} \end{bmatrix}, \text{ and} \quad \text{(Equation 3)}$$

$$X = \begin{bmatrix} \cos(\theta_B^{M_i}) - \cos(\theta_B^{M_{1\ldots N(\neq i)}}) \\ \sin(\theta_B^{M_i}) - \sin(\theta_B^{M_{1\ldots N(\neq i)}}) \\ \cos(\theta_S^{M_i}) - \cos(\theta_S^{M_{1\ldots N(\neq i)}}) \\ \sin(\theta_S^{M_i}) - \sin(\theta_S^{M_{1\ldots N(\neq i)}}) \\ \sin(\theta_B^{M_i}) - \sin(\theta_B^{M_{1\ldots N(\neq i)}}) \\ -\cos(\theta_B^{M_i}) + \cos(\theta_B^{M_{1\ldots N(\neq i)}}) \\ \sin(\theta_S^{M_i}) - \sin(\theta_S^{M_{1\ldots N(\neq i)}}) \\ -\cos(\theta_S^{M_i}) + \cos(\theta_S^{M_{1\ldots N(\neq i)}}) \end{bmatrix}. \quad \text{(Equation 4)}$$

Further, for each of $P_1$-$P_4$:

$$P_1=L_B\cos(\theta_B^{Bias}), \quad \text{(Equation 5)}$$

$$P_2=L_B\sin(\theta_B^{Bias}), \quad \text{(Equation 6)}$$

$$P_3=L_S\cos(\theta_S^{Bias}), \text{ and} \quad \text{(Equation 7)}$$

$$P_4=L_S\sin(\theta_S^{Bias}). \quad \text{(Equation 8)}$$

The above equations are configured to be rearranged into the following equations to solve for $L_B$, $L_S$, $\theta_B^{Bias}$, and $\theta_S^{Bias}$:

$$\theta_B^{Bias}=\tan^{-1}(P_2/P_1), \quad \text{(Equation 9)}$$

$$\theta_S^{Bias}=\tan^{-1}(P_4/P_3), \quad \text{(Equation 10)}$$

$$L_B=P_1/\cos(\theta_B^{Bias}), \text{ and} \quad \text{(Equation 11)}$$

$$L_S=P_3/\cos(\theta_S^{Bias}). \quad \text{(Equation 12)}$$

In an embodiment, the excavator boom comprises a variable-angle (VA) excavator boom. For example, referring to FIG. 5, where the excavating linkage assembly 154 comprises a variable-angle (VA) excavator boom 158, a VA boom dynamic sensor may be positioned on the VA excavator boom 158. Further, the iterative process may comprise generating a VA boom measured angle from the VA boom dynamic sensor. Further, the optimization may comprise parameters directed toward the VA excavator boom 158 to determine a VA boom limb length $L_V$, and a VA boom offset angle $\theta_V^{Bias}$.

For example, with respect to Equation 1 above for the excavator 150 including the VA excavator boom 158, P comprises a vector comprising a set of constants that are a function of at least one of $L_B$, $L_S$, $L_V$, $\theta_B^{Bias}$, $\theta_S^{Bias}$, and $\theta_V^{Bias}$, X comprises a vector based on the corresponding set of boom measured angles $\theta_B$ and stick measured angles $\theta_S$ and VA boom measured angles $\theta_V$, and Y comprises a vector based on the set of height H and distance D measurements. Further, Equations 2 and 4 change to the following equations:

$$P=[P_1, P_2, P_3, P_4, P_5, P_6], \text{ and} \quad \text{(Equation 13)}$$

$$X=\begin{bmatrix} \cos(\theta_B^{M_i})-\cos(\theta_B^{M_{1\ldots N(\neq i)}}) \\ \sin(\theta_B^{M_i})-\sin(\theta_B^{M_{1\ldots N(\neq i)}}) \\ \cos(\theta_S^{M_i})-\cos(\theta_S^{M_{1\ldots N(\neq i)}}) \\ \sin(\theta_S^{M_i})-\sin(\theta_S^{M_{1\ldots N(\neq i)}}) \\ \cos(\theta_V^{M_i})-\cos(\theta_V^{M_{1\ldots N(\neq i)}}) \\ \sin(\theta_V^{M_i})-\sin(\theta_V^{M_{1\ldots N(\neq i)}}) \\ \sin(\theta_B^{M_i})-\sin(\theta_B^{M_{1\ldots N(\neq i)}}) \\ -\cos(\theta_B^{M_i})+\cos(\theta_B^{M_{1\ldots N(\neq i)}}) \\ \sin(\theta_S^{M_i})-\sin(\theta_S^{M_{1\ldots N(\neq i)}}) \\ -\cos(\theta_S^{M_i})+\cos(\theta_S^{M_{1\ldots N(\neq i)}}) \\ \sin(\theta_V^{M_i})-\sin(\theta_V^{M_{1\ldots N(\neq i)}}) \\ -\cos(\theta_V^{M_i})+\cos(\theta_V^{M_{1\ldots N(\neq i)}}) \end{bmatrix}. \quad \text{(Equation 14)}$$

With respect to new equation 13, equations 5-8 above still apply for $P_1$-$P_4$ as well as the below new equations for $P_5$-$P_6$:

$$P_5=L_V\cos(\theta_V^{Bias}), \text{ and} \quad \text{(Equation 15)}$$

$$P_6=L_V\sin(\theta_V^{Bias}), \quad \text{(Equation 16)}$$

Equations 15-16 are further configured to be rearranged into the following equations to solve for $L_V$ and $\theta_V^{Bias}$:

$$\theta_V^{Bias}=\tan^{-1}(P_6/P_5), \text{ and} \quad \text{(Equation 17)}$$

$$L_V=P_5/\cos(\theta_V^{Bias}). \quad \text{(Equation 18)}$$

In embodiments, and with reference to FIG. 4, the height H and the distance D measurements between the calibration node 128 and the LDM 124 follow:

$$H=D_{LDM}\sin(\theta_{INC}), \text{ and} \quad \text{(Equation 19)}$$

$$D=D_{LDM}\cos(\theta_{INC}). \quad \text{(Equation 20)}$$

Further, a sum of a height $H_0$ of the LDM 124 from a terminal point A of the excavator boom 108 and the height H between the calibration node 128 and the LDM 124 is equal to an equation including a boom actual angle $\theta_B^{Actual}$ and a stick actual angle $\theta_S^{Actual}$ such that $$H_0+H=L_B\cos(\theta_B^{Actual})+L_S\cos(\theta_S^{Actual}). \quad \text{(Equation 21)}$$

Further, a sum of a distance $D_0$ of the LDM from a terminal point A of the excavator boom and the distance D between the calibration node 128 and the LDM 124 is equal to an equation including $\theta_B^{Actual}$ and $\theta_S^{Actual}$ such that $$D_0+D=L_B\sin(\theta_B^{Actual})+L_S\sin(\theta_S^{Actual}), \quad \text{(Equation 22)}$$

Additionally, the boom measured angle $\theta_B$ is equal to $\theta_B^{Actual}+\theta_B^{Bias}$ such that $$\sin(\theta_B^{Actual})=\sin(\theta_B-\theta_B^{Bias}) \text{ and } \cos(\theta_B^{Actual})=\cos(\theta_B-\theta_B^{Bias}). \quad \text{(Equation 23)}$$

Further, the stick measured angle $\theta_S$ is equal to $\theta_S^{Actual}+\theta_S^{Bias}$ such that $$\sin(\theta_S^{Actual})=\sin(\theta_S-\theta_S^{Bias}) \text{ and } \cos(\theta_S^{Actual})=\cos(\theta_S-\theta_S^{Bias}). \quad \text{(Equation 24)}$$

Through use of a trigonometric identity:

$$\sin(\theta_X^{Actual})=\sin(\theta_X-\theta_X^{Bias})=\cos(\theta_X^{Bias})\sin(\theta_X)-\sin(\theta_X^{Bias})\cos(\theta_X)=K_{1X}\sin(\theta_X)-K_{2X}\cos(\theta_X), \text{ and} \quad \text{(Equation 25)}$$

$$\cos(\theta_X^{Actual})=\cos(\theta_X-\theta_X^{Bias})=\cos(\theta_X^{Bias})\cos(\theta_X)+\sin(\theta_X^{Bias})\sin(\theta_X)=K_{1X}\cos(\theta_X)+K_{2X}\sin(\theta_X). \quad \text{(Equation 26)}$$

In the above equations, $\theta_X$ is one of $\theta_B$ and $\theta_S$ (or $\theta_V$ as described in greater detail below) such that X is a respective one of B and S (or V), and $$K_{1X}=\cos(\theta_X^{Bias}) \text{ and } K_{2X}=\sin(\theta_X^{Bias}). \quad \text{(Equation 27)}$$

For example, with respect to $\theta_B^{Actual}$, $$\sin(\theta_B^{Actual})=\sin(\theta_B-\theta_B^{Bias})=\cos(\theta_B^{Bias})\sin(\theta_B)-\sin(\theta_B^{Bias})\cos(\theta_B)=K_{1B}\sin(\theta_B)-K_{2B}\cos(\theta_B), \quad \text{(Equation 28)}$$

Where $$K_{1B}=\cos(\theta_B^{Bias}) \text{ and } K_{2B}=\sin(\theta_B^{Bias}), \text{ and} \quad \text{(Equation 29)}$$

$$\cos(\theta_B^{Actual})=\cos(\theta_B-\theta_B^{Bias})=\cos(\theta_B^{Bias})\cos(\theta_B)+\sin(\theta_B^{Bias})\sin(\theta_B)=K_{1B}\cos(\theta_B)+K_{2B}\sin(\theta_B). \quad \text{(Equation 30)}$$

Additionally, with respect to $\theta_S^{Actual}$, $$\sin(\theta_S^{Actual})=\sin(\theta_S-\theta_S^{Bias})=\cos(\theta_S^{Bias})\sin(\theta_S)-\sin(\theta_S^{Bias})\cos(\theta_S)=K_{1S}\sin(\theta_S)-K_{2S}\cos(\theta_S), \quad \text{(Equation 31)}$$

where $$K_{1S}=\cos(\theta_S^{Bias}) \text{ and } K_{2S}=\sin(\theta_S^{Bias}), \text{ and} \quad \text{(Equation 32)}$$

$$\cos(\theta_S^{Actual})=\cos(\theta_S-\theta_S^{Bias})=\cos(\theta_S^{Bias})\cos(\theta_S)+\sin(\theta_S^{Bias})\sin(\theta_S)=K_{1S}\cos(\theta_S)+K_{2S}\sin(\theta_S). \quad \text{(Equation 33)}$$

Thus, from equations 21-22, respectfully, and the above trigonometric identity based equations, $$H_0+H=L_BK_{1B}\cos(\theta_B)+L_BK_{2B}\sin(\theta_B)+L_SK_{1S}\cos(\theta_S)+L_SK_{2S}\sin(\theta_S),\text{ and} \quad \text{(Equation 34)}$$

$$D_0+D=L_BK_{1B}\sin(\theta_B)-L_BK_{2B}\cos(\theta_B)+L_SK_{1S}\sin(\theta_S)-L_SK_{2S}\cos(\theta_S). \quad \text{(Equation 35)}$$

Further, a set of solvable constants $P_1$, $P_2$, $P_3$, and $P_4$ are defined as follows:

$$P_1=L_BK_{1B}, \quad \text{(Equation 36)}$$

$$P_2=L_BK_{2B}, \quad \text{(Equation 37)}$$

$$P_3=L_SK_{1S},\text{ and} \quad \text{(Equation 38)}$$

$$P_4=L_SK_{2S}. \quad \text{(Equation 39)}$$

to form a first position equation set:

$$H_0+H=P_1\cos(\theta_B)+P_2\sin(\theta_B)+P_3\cos(\theta_S)+P_4\sin(\theta_S),\text{ and } D_0+D=P_1\sin(\theta_B)-P_2\cos(\theta_B)+P_3\sin(\theta_S)-P_4\cos(\theta_S). \quad \text{(First Position Equation Set)}$$

The iterative process may further comprise finding, for each linkage assembly position, a second position equation set comprising vectors:

$$H_0+H^{Measured}=[P_1, P_2, P_3, P_4][\cos(\theta_B), \sin(\theta_B), \cos(\theta_S), \sin(\theta_S)]^T,\text{ and } D_0+D^{Measured}=[P_1, P_2, P_3, P_4][\sin(\theta_B), -\cos(\theta_B), \sin(\theta_S), -\cos(\theta_S)]^T. \quad \text{(Second Position Equation Set)}$$

The iterative process may further comprise combining at least two sets of data in the second position equation set and subtracting to remove $H_0$ and $D_0$ define a third position equation set upon which the linear least squares optimization is used to solve for $[P_1, P_2, P_3, P_4]$:

(Third Position Equation Set)

$$H^{M_i}-H^{M_{1\ldots N(\neq i)}}=[P_1, P_2, P_3, P_4]\begin{bmatrix}\cos(\theta_B^{M_i})-\cos(\theta_B^{M_{1\ldots N(\neq i)}})\\ \sin(\theta_B^{M_i})-\sin(\theta_B^{M_{1\ldots N(\neq i)}})\\ \cos(\theta_S^{M_i})-\cos(\theta_S^{M_{1\ldots N(\neq i)}})\\ \sin(\theta_S^{M_i})-\sin(\theta_S^{M_{1\ldots N(\neq i)}})\end{bmatrix},\text{ and}$$

$$D^{M_i}-D^{M_{1\ldots N(\neq i)}}=[P_1, P_2, P_3, P_4]\begin{bmatrix}\sin(\theta_B^{M_i})-\sin(\theta_B^{M_{1\ldots N(\neq i)}})\\ -\cos(\theta_B^{M_i})+\cos(\theta_B^{M_{1\ldots N(\neq i)}})\\ \sin(\theta_S^{M_i})-\sin(\theta_S^{M_{1\ldots N(\neq i)}})\\ -\cos(\theta_S^{M_i})+\cos(\theta_S^{M_{1\ldots N(\neq i)}})\end{bmatrix}.$$

In an embodiment in which the excavator comprises a VA excavator boom, the above equations would include associated VA boom parameters as set forth below:

$$H_0+H=L_B\cos(\theta_B^{Actual})+L_S\cos(\theta_S^{Actual})+L_V\cos(\theta_V^{Actual}) \quad \text{(Equation 40)}$$

$$D_0+D=L_B\sin(\theta_B^{Actual})+L_S\sin(\theta_S^{Actual})+L_V\sin(\theta_V^{Actual}), \quad \text{(Equation 41)}$$

Additionally, these equations would further be defined, including the associated parameters, as set forth below:

$$H_0+H=L_BK_{1B}\cos(\theta_B)+L_BK_{2B}\sin(\theta_B)+L_SK_{1S}\cos(\theta_S)+L_SK_{2S}\sin(\theta_S)+L_VK_{1V}\cos(\theta_V)+L_VK_{2V}\sin(\theta_V),\text{ and} \quad \text{(Equation 42)}$$

$$D_0+D=L_BK_{1B}\sin(\theta_B)-L_BK_{2B}\cos(\theta_B)+L_SK_{1S}\sin(\theta_S)-L_SK_{2S}\cos(\theta_S)+L_VK_{1V}\sin(\theta_V)-L_VK_{2V}\cos(\theta_V). \quad \text{(Equation 43)}$$

Further, in an embodiment in which the VA excavator boom is included, the equation would include associated parameters as set forth below:

$$P_5=L_VK_{1V},\text{ and} \quad \text{(Equation 44)}$$

$$P_6=L_VK_{2V}, \quad \text{(Equation 45)}$$

Thus, the following first position equation set may be formed:

$$H_0+H=P_1\cos(\theta_B)+P_2\sin(\theta_B)+P_3\cos(\theta_S)+P_4\sin(\theta_S)+P_5\cos(\theta_V)+P_6\sin(\theta_V),\text{ and } D_0+D=P_1\sin(\theta_B)-P_2\cos(\theta_B)+P_3\sin(\theta_S)-P_4\cos(\theta_S)+P_5\sin(\theta_V)-P_6\cos(\theta_V). \quad \text{(First VA Position Equation Set)}$$

The iterative process would comprise finding, for each linkage assembly position, a second position equation set comprising vectors:

$$H_0+H^{Measured}=[P_1, P_2, P_3, P_4, P_5, P_6][\cos(\theta_B), \sin(\theta_B), \cos(\theta_S), \sin(\theta_S), \cos(\theta_V), \sin(\theta_V)]^T,\text{ and } D_0+D^{Measured}=[P_1, P_2, P_3, P_4, P_5, P_6][\sin(\theta_B), -\cos(\theta_B), \sin(\theta_S), -\cos(\theta_S), \sin(\theta_V), -\cos(\theta_V)]^T. \quad \text{(Second VA Position Equation Set)}$$

The iterative process would further comprise combining at least two sets of data in the second position equation set and subtracting to remove $H_0$ and $D_0$ define a third position equation set upon which the linear least squares optimization is used to solve for $[P_1, P_2, P_3, P_4, P_5, P_6]$:

(Third VA Position Equation Set)

$$H^{M_i}-H^{M_{1\ldots N(\neq i)}}=[P_1, P_2, P_3, P_4, P_5, P_6]\begin{bmatrix}\cos(\theta_B^{M_i})-\cos(\theta_B^{M_{1\ldots N(\neq i)}})\\ \sin(\theta_B^{M_i})-\sin(\theta_B^{M_{1\ldots N(\neq i)}})\\ \cos(\theta_S^{M_i})-\cos(\theta_S^{M_{1\ldots N(\neq i)}})\\ \sin(\theta_S^{M_i})-\sin(\theta_S^{M_{1\ldots N(\neq i)}})\\ \cos(\theta_V^{M_i})-\cos(\theta_V^{M_{1\ldots N(\neq i)}})\\ \sin(\theta_V^{M_i})-\sin(\theta_V^{M_{1\ldots N(\neq i)}})\end{bmatrix},$$

and $$D^{M_i}-D^{M_{1\ldots N(\neq i)}}=[P_1, P_2, P_3, P_4, P_5, P_6]\begin{bmatrix}\sin(\theta_B^{M_i})-\sin(\theta_B^{M_{1\ldots N(\neq i)}})\\ -\cos(\theta_B^{M_i})+\cos(\theta_B^{M_{1\ldots N(\neq i)}})\\ \sin(\theta_S^{M_i})-\sin(\theta_S^{M_{1\ldots N(\neq i)}})\\ -\cos(\theta_S^{M_i})+\cos(\theta_S^{M_{1\ldots N(\neq i)}})\\ \sin(\theta_V^{M_i})-\sin(\theta_V^{M_{1\ldots N(\neq i)}})\\ -\cos(\theta_V^{M_i})+\cos(\theta_V^{M_{1\ldots N(\neq i)}})\end{bmatrix},.$$

It is contemplated that the embodiments of the present disclosure may assist to permit a speedy and more cost efficient method of determining limb lengths and sensor offsets of sensors on excavator limbs in a manner that minimizes a risk of human error with such value determinations. Further, a quick linear-in-the-parameters optimization as described herein allows for a speedier optimization than a non-linear optimization would allow, and the controller of the excavator or other control technologies are improved such that the processing systems are improved with respect to speed, efficiency, and output.

A signal may be "generated" by direct or indirect calculation or measurement, with or without the aid of a sensor.

For the purposes of describing and defining the present invention, it is noted that reference herein to a variable being a "function" of (or "based on") a parameter or another variable is not intended to denote that the variable is exclusively a function of or based on the listed parameter or variable. Rather, reference herein to a variable that is a "function" of or "based on" a listed parameter is intended to be open ended such that the variable may be a function of (or based on) a single parameter or a plurality of parameters.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An excavator calibration framework comprising an excavator, a laser distance meter (LDM), and a laser reflector, wherein:

the excavator comprises a machine chassis, an excavating linkage assembly, a boom dynamic sensor, a stick dynamic sensor, an excavating implement, and control architecture;

the excavating linkage assembly comprises an excavator boom and an excavator stick that collectively define a plurality of linkage assembly positions;

the boom dynamic sensor is positioned on the excavator boom and the stick dynamic sensor is positioned on the excavator stick;

the excavating linkage assembly is configured to swing with, or relative to, the machine chassis;

the excavator stick is configured to curl relative to the excavator boom;

the excavating implement is mechanically coupled to the excavator stick;

the LDM is configured to generate an LDM distance signal $D_{LDM}$ indicative of a distance between the LDM and the laser reflector and an angle of inclination $\theta_{INC}$ indicative of an angle between the LDM and the laser reflector;

the laser reflector is configured to be disposed at a position corresponding to a calibration node on the excavator stick; and the control architecture comprises one or more linkage assembly actuators and an architecture controller programmed to execute an iterative process at successive linkage assembly positions, the iterative process comprising generating a boom measured angle $\theta_B$ from the boom dynamic sensor, generating a stick measured angle $\theta_S$ from the stick dynamic sensor, and calculating a height H and a distance D between the calibration node and the LDM based on the LDM distance signal $D_{LDM}$ and angle of inclination $\theta_{INC}$; and the architecture controller is further programmed to build a set of height H and distance D measurements and a corresponding set of boom measured angles $\theta_B$ and stick measured angles $\theta_S$ for n linkage assembly positions, execute an optimization process comprising a linear least squares optimization based on the set of height H and distance D measurements and the corresponding set of boom measured angles $\theta_B$ and stick measured angles $\theta_S$ to determine a boom limb length $L_B$, a stick limb length $L_S$, a boom offset angle $\theta_B^{Bias}$, and a stick offset angle $\theta_S^{Bias}$, and operate the excavator using $L_B$, $L_S$, $\theta_B^{Bias}$, and $\theta_S^{Bias}$.

2. An excavator calibration framework as claimed in claim 1, wherein the linear least squares optimization comprises a following optimization equation:

$$P=(X^TX)^{-1}X^TY$$

where P comprises a vector comprising a set of constants that are a function of at least one of $L_B$, $L_S$, $\theta_B^{Bias}$, and $\theta_S^{Bias}$, X comprises a vector based on the corresponding set of boom measured angles $\theta_B$ and stick measured angles $\theta_S$, and Y comprises a vector based on the set of height H and distance D measurements.

3. An excavator calibration framework as claimed in claim 2, wherein for N linkage assembly positions ending at a linkage assembly position i, $$P = [P_1, P_2, P_3, P_4],$$

$$Y = \begin{bmatrix} H^{M_i} - H^{M_{1\ldots N(\neq i)}} \\ D^{M_i} - D^{M_{1\ldots N(\neq i)}} \end{bmatrix}, \text{ and}$$

$$X = \begin{bmatrix} \cos(\theta_B^{M_i}) - \cos(\theta_B^{M_{1\ldots N(\neq i)}}) \\ \sin(\theta_B^{M_i}) - \sin(\theta_B^{M_{1\ldots N(\neq i)}}) \\ \cos(\theta_S^{M_i}) - \cos(\theta_S^{M_{1\ldots N(\neq i)}}) \\ \sin(\theta_S^{M_i}) - \sin(\theta_S^{M_{1\ldots N(\neq i)}}) \\ \sin(\theta_B^{M_i}) - \sin(\theta_B^{M_{1\ldots N(\neq i)}}) \\ -\cos(\theta_B^{M_i}) + \cos(\theta_B^{M_{1\ldots N(\neq i)}}) \\ \sin(\theta_S^{M_i}) - \sin(\theta_S^{M_{1\ldots N(\neq i)}}) \\ -\cos(\theta_S^{M_i}) + \cos(\theta_S^{M_{1\ldots N(\neq i)}}) \end{bmatrix}..$$

4. An excavator calibration framework as claimed in claim 2, wherein $$P_1 = L_B \cos(\theta_B^{Bias}),$$

$$P_2 = L_B \sin(\theta_B^{Bias}),$$

$$P_3 = L_S \cos(\theta_S^{Bias}), \text{ and}$$

$$P_4 = L_S \sin(\theta_S^{Bias}),$$

which are configured to be rearranged into the following equations to solve for $L_B$, $L_S$, $\theta_B^{Bias}$, and $\theta_S^{Bias}$:

$$\theta_B^{Bias} = \tan^{-1}(P_2/P_1),$$

$$\theta_S^{Bias} = \tan^{-1}(P_4/P_3),$$

$$L_B = P_1/\cos(\theta_B^{Bias}), \text{ and}$$

$$L_S = P_3/\cos(\theta_S^{Bias}).$$

5. An excavator calibration framework as claimed in claim 1, wherein:

the excavator boom comprises a variable-angle (VA) excavator boom, and a VA boom dynamic sensor is positioned onte VA excavator boom.

6. An excavator calibration framework as claimed in claim 5, wherein:

the iterative process further comprises generating a VA boom measured angle from the VA boom dynamic sensor; and the optimization further comprises parameters directed toward the VA excavator boom to determine a VA boom limb length $L_V$, and a VA boom offset angle $\theta_V^{Bias}$.

7. An excavator calibration framework as claimed in claim 6, wherein the linear least squares optimization comprises a following optimization equation:

$$P = (X^T X)^{-1} X^T Y$$

where:

P comprises a vector comprising a set of constants that are a function of at least one of $L_B$, $L_S$, $L_V$, $\theta_B^{Bias}$, $\theta_S^{Bias}$, and $\theta_V^{Bias}$, X comprises a vector based on the corresponding set of boom measured angles $\theta_B$ and stick measured angles $\theta_S$ and VA boom measured angles $\theta_V$, and Y comprises a vector based on the set of height H and distance D measurements.

8. An excavator calibration framework as claimed in claim 5, wherein, for N linkage assembly positions ending at a linkage assembly position i, $$P = [P_1, P_2, P_3, P_4, P_5, P_6],$$

$$Y = \begin{bmatrix} H^{M_i} - H^{M_{1\ldots N(\neq i)}} \\ D^{M_i} - D^{M_{1\ldots N(\neq i)}} \end{bmatrix}, \text{ and}$$

$$X = \begin{bmatrix} \cos(\theta_B^{M_i}) - \cos(\theta_B^{M_{1\ldots N(\neq i)}}) \\ \sin(\theta_B^{M_i}) - \sin(\theta_B^{M_{1\ldots N(\neq i)}}) \\ \cos(\theta_S^{M_i}) - \cos(\theta_S^{M_{1\ldots N(\neq i)}}) \\ \sin(\theta_S^{M_i}) - \sin(\theta_S^{M_{1\ldots N(\neq i)}}) \\ \cos(\theta_V^{M_i}) - \cos(\theta_V^{M_{1\ldots N(\neq i)}}) \\ \sin(\theta_V^{M_i}) - \sin(\theta_V^{M_{1\ldots N(\neq i)}}) \\ \sin(\theta_B^{M_i}) - \sin(\theta_B^{M_{1\ldots N(\neq i)}}) \\ -\cos(\theta_B^{M_i}) + \cos(\theta_B^{M_{1\ldots N(\neq i)}}) \\ \sin(\theta_S^{M_i}) - \sin(\theta_S^{M_{1\ldots N(\neq i)}}) \\ -\cos(\theta_S^{M_i}) + \cos(\theta_S^{M_{1\ldots N(\neq i)}}) \\ \sin(\theta_V^{M_i}) - \sin(\theta_V^{M_{1\ldots N(\neq i)}}) \\ -\cos(\theta_V^{M_i}) + \cos(\theta_V^{M_{1\ldots N(\neq i)}}) \end{bmatrix}.$$

9. An excavator calibration framework as claimed in claim 5, wherein $$P_1 = L_B \cos(\theta_B^{Bias}),$$

$$P_2 = L_B \sin(\theta_B^{Bias}),$$

$$P_3 = L_S \cos(\theta_S^{Bias}),$$

$$P_4 = L_S \sin(\theta_S^{Bias}),$$

$$P_5 = L_V \cos(\theta_V^{Bias}), \text{ and}$$

$$P_6 = L_V \sin(\theta_V^{Bias}),$$

which are configured to be rearranged into the following equations to solve for $L_B$, $L_S$, $L_V$, $\theta_B^{Bias}$, $\theta_S^{Bias}$, and $\theta_V^{Bias}$:

$$\theta_B^{Bias} = \tan^{-1}(P_2/P_1),$$

$$\theta_S^{Bias} = \tan^{-1}(P_4/P_3),$$

$$\theta_V^{Bias} = \tan^{-1}(P_6/P_5),$$

$$L_B = P_1/\cos(\theta_B^{Bias}),$$

$$L_S = P_3/\cos(\theta_S^{Bias}), \text{ and}$$

$$L_V = P_5/\cos(\theta_S^{Bias}).$$

10. An excavator calibration framework as claimed in claim 1, wherein the laser reflector is disposed on a pole.

11. An excavator calibration framework as claimed in claim 1, wherein the laser reflector is secured directly to the excavator stick.

12. An excavator calibration framework as claimed in claim 1, wherein the calibration node is at a terminal point G of the excavator stick at an end of the excavator stick mechanically coupled to the excavating implement.

13. An excavator calibration framework as claimed in claim 12, wherein the laser reflector is disposed at the terminal point G.

14. An excavator calibration framework as claimed in claim 1, wherein the boom measured angle $\theta_B$ represents an angle of the excavator boom relative to vertical, and the stick measured angle $\theta_S$ represents an angle of the excavator stick relative to vertical.

15. An excavator calibration framework as claimed in claim 1, wherein at least one of the dynamic sensors comprise an inertial measurement unit (IMU), an inclinometer, an accelerometer, a gyroscope, an angular rate sensor, a rotary position sensor, a position sensing cylinder, or combinations thereof.

16. An excavator calibration framework as claimed in claim 1, wherein at least one of the dynamic sensors comprise an IMU comprising a 3-axis accelerometer and a 3-axis gyroscope.

17. An excavator calibration framework as claimed in claim 1, wherein:

the optimization process is executed using the height H and distance D measurements and the corresponding set of boom measured angles $\theta_B$ and stick measured angles $\theta_S$ for n−1 linkage assembly positions; and the optimization process comprises a validation routine using height H and distance D measurements and corresponding boom and stick measured angles $\theta_B$, $\theta_S$ for a remaining linkage assembly position of the n linkage assembly positions.

18. An excavator calibration framework as claimed in claim 1, wherein:

the optimization process is executed using the height H and distance D measurements and the corresponding set of boom measured angles $\theta_B$ and stick measured angles $\theta_S$ for n−1 linkage assembly positions; and the optimization process comprises displaying a progress bar on a graphical user interface of the excavator calibration framework configured to display a change in a preceding last three estimations for at least one of $L_B$, $L_S$, $\theta_B^{Bias}$, and $\theta_S^{Bias}$.

19. An excavator calibration framework as claimed in claim 18, wherein the progress bar displays a change in a preceding last three estimations of $L_B$.

20. An excavator calibration framework comprising an excavator, a laser distance meter (LDM), and a laser reflector, wherein:

the excavator comprises a machine chassis, an excavating linkage assembly, a boom dynamic sensor, a stick dynamic sensor, an excavating implement, and control architecture;

the excavating linkage assembly comprises an excavator boom and an excavator stick that collectively define a plurality of linkage assembly positions;

the boom dynamic sensor is positioned on the excavator boom and the stick dynamic sensor is positioned on the excavator stick;

the excavating linkage assembly is configured to swing with, or relative to, the machine chassis;

the excavator stick is configured to curl relative to the excavator boom;

the excavating implement is mechanically coupled to the excavator stick;

the LDM is configured to generate an LDM distance signal $D_{LDM}$ indicative of a distance between the LDM and the laser reflector and an angle of inclination $\theta_{INC}$ indicative of an angle between the LDM and the laser reflector;

the laser reflector is configured to be disposed at a position corresponding to a calibration node of the excavator stick, the calibration node is at a terminal point G of the excavator stick at an end of the excavator stick mechanically coupled to the excavating implement, and the laser reflector disposed at the terminal point G; and the control architecture comprises one or more linkage assembly actuators and an architecture controller programmed to execute an iterative process at successive linkage assembly positions, the iterative process comprising generating a boom measured angle $\theta_B$ from the boom dynamic sensor, generating a stick measured angle $\theta_S$ from the stick dynamic sensor, and calculating a height H and a distance D between the calibration node and the LDM based on the LDM distance signal $D_{LDM}$ and angle of inclination $\theta_{INC}$; and the architecture controller is further programmed to build a set of height H and distance D measurements and a corresponding set of boom measured angles $\theta_B$ and stick measured angles $\theta_S$ for n linkage assembly positions, execute an optimization process comprising a linear least squares optimization based on the set of height H and distance D measurements and the corresponding set of boom measured angles $\theta_B$ and stick measured angles $\theta_S$ to determine a boom limb length $L_B$, a stick limb length $L_S$, a boom offset angle $\theta_B^{Bias}$, and a stick offset angle $\theta_S^{Bias}$, and operate the excavator using $L_B$, $L_S$, $\theta_B^{Bias}$, and $\theta_S^{Bias}$, and the linear least squares optimization comprises a following optimization equation:

$$P=(X^TX)^{-1}X^TY$$

where P comprises a vector comprising a set of constants that are a function of at least one of $L_B$, $L_S$, $\theta_B^{Bias}$, and $\theta_S^{Bias}$, X comprises a vector based on the corresponding set of boom measured angles $\theta_B$ and stick measured angles $\theta_S$, and Y comprises a vector based on the set of height H and distance D measurements.

* * * * *